US007845318B2

(12) United States Patent
Park

(10) Patent No.: US 7,845,318 B2
(45) Date of Patent: Dec. 7, 2010

(54) INTAKE AND EXHAUST DEVICE EQUIPPED WITH FIRST AND SECOND VALVE DISKS

(75) Inventor: Byung Ok Park, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 402 days.

(21) Appl. No.: 12/106,754

(22) Filed: Apr. 21, 2008

(65) Prior Publication Data

US 2009/0126671 A1 May 21, 2009

(30) Foreign Application Priority Data

Nov. 19, 2007 (KR) ..... 10-2007-0118032

(51) Int. Cl.
*F01L 7/06* (2006.01)

(52) U.S. Cl. ..... 123/80 D; 123/190.14

(58) Field of Classification Search ..... 123/73 D, 123/80 D, 81 D, 190.14
See application file for complete search history.

(56) References Cited

FOREIGN PATENT DOCUMENTS

JP 3-253709 A 11/1991
JP 2005-264903 A 9/2005

*Primary Examiner*—Noah Kamen
(74) *Attorney, Agent, or Firm*—Morgan, Lewis & Bockius LLP

(57) ABSTRACT

The intake and exhaust device equipped with a first valve disk and a second valve disk may include a cylinder in which an intake port and an exhaust port are formed, a circular first valve disk in which a first hole corresponding to one of the intake port and the exhaust port is formed and that covers an upper side of the cylinder including the intake port and the exhaust port, a circular second valve disk that is slidingly overlapped on the first valve disk and in which a second hole corresponding to the first hole is formed, a first driving portion for rotating a first driving pipe, a second driving portion for rotating a second driving pipe, and a control portion for controlling the first driving portion, the second driving portion, the intake port or the exhaust port.

12 Claims, 11 Drawing Sheets

FIG.4

| | 100 | 102 |
|---|---|---|
| first uppermost point | | |
| intake stroke | | |
| first lowermost point | | |
| compress stroke | | |
| second uppermost point | | |
| explosion stroke | | |
| second lowermost point | | |
| exhaust stroke | | |

INTAKE AND EXHAUST DEVICE EQUIPPED WITH FIRST AND SECOND VALVE DISKS

CROSS-REFERENCE TO RELATED APPLICATION

This application claims priority to and the benefit of Korean Patent Application No. 10-2007-0118032 filed in the Korean Intellectual Property Office on Nov. 19, 2007, the entire contents of which are incorporated herein by reference.

BACKGROUND OF THE INVENTION (a) Field of the Invention

The present invention relates to an intake and exhaust device of a cylinder. More particularly, the present invention relates to an intake and exhaust device of a cylinder for opening and closing an intake port and an exhaust port.

(b) Description of the Related Art

Generally, an intake port and an exhaust port are formed in an upper portion of a cylinder. Valves are provided in a cylinder head to open and close the ports. Crankshaft energy causes the valves to open and close the ports.

Particularly, a valve can impact with a piston when the valve does not move with appropriate timing. Further, a sealing seat that comes into contact with a combustion gas provided at a head side of the valve can be worn away. When the wearing amount becomes increased, engine performance is deteriorated and a vehicle cannot be started.

A mechanism for transmitting a driving torque from the crankshaft to the valve of the cylinder head is needed to drive the valve, but the mechanism is complicated and causes a power loss. Recently, a chain has been used as a torque transmitting device, but the cost for providing a mechanism to drive the valve has increased.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an intake and exhaust device equipped with a first valve disk and a second valve disk having advantages in that a valve does not impact with a piston, a sealing property is not deteriorated by wear, and power loss of an engine is reduced. Also, the present invention has been made in an effort to provide an intake and exhaust device equipped with a first valve disk and a second valve disk having advantages of simplifying a mechanism for transferring torque from a crankshaft to a valve, so the structure thereof is compact and manufacturing cost is reduced.

The intake and exhaust device equipped with a first valve disk and a second valve disk according to the exemplary embodiment of the present invention may include a cylinder in which an intake port and an exhaust port are formed, a circular first valve disk in which a first hole corresponding to one of the intake port and the exhaust port is formed and that covers an upper side of the cylinder including the intake port and the exhaust port, a circular second valve disk that is slidingly overlapped on the first valve disk and in which a second hole corresponding to the first hole is formed, a first driving portion for rotating a first driving pipe that is fixed to a center of the first valve disk, a second driving portion for rotating a second driving pipe that surrounds the first driving pipe and is fixed to the second valve disk, and a control portion for controlling the first driving portion and the second driving portion and that opens or closes the intake port or the exhaust port when the first valve disk or the second valve disk rotate.

The control portion may include a first control disk of which a center portion thereof is connected to a crankshaft to rotate and a first electric terminal is formed adjacent to an edge thereof, a second control disk that is overlapped on a side of the first control disk and that has a second electric terminal configured to correspond to the first electric terminal, and a third control disk that is overlapped on other side of the second control disk and that has two third electric terminals formed to alternatively correspond to the second electric terminal and that are symmetrically formed at 180 degrees from each other.

The control portion may include a first control disk of which a center portion thereof is connected to a crankshaft to rotate and two first electric terminals are symmetrically formed at 180 degrees to each other on an edge thereof, a second control disk that is overlapped on a side of the first control disk and having a second electric terminal configured to alternatively correspond to one of the first electric terminals, and a third control disk that is overlapped on other side of the second control disk, and two third electric terminals are formed symmetrically at 180 degrees from each other on an edge thereof to alternatively correspond to the second electric terminal.

The driving portion may be operated by an electric motor, and the driving portion maybe engaged with the first driving pipe by a spiral bevel gear.

There may be the two intake ports and the two exhaust ports in a cylinder, and there may be two first holes and two second holes corresponding to the intake ports or the exhaust ports.

The number of cylinders may be four. The first driving pipe may have a pipe shape, and an ignition device is inserted into the cylinder through the first driving pipe. The ignition device is a spark plug, and the diameter of the first hole and the second hole is equal to or larger than a diameter of the intake port or the exhaust port.

The intake valve and exhaust valve do not move into an inner space of the cylinder, so the piston does not collide with the valve.

Also, a link structure for transmitting a driving torque from the crankshaft to the intake valve or the exhaust valve and a timing belt are not needed, so the number of components is decreased and the structure is simplified.

Further, a driving torque is not transmitted from the crankshaft to the intake valve or the exhaust valve, so a load of the engine is decreased.

Also, the intake port and the exhaust port are opened completely, so resistance of the intake and the exhaust is decreased and efficiency of the engine is increased. In addition, the efficiency reduction of the engine resulting from wear of the valve can be decreased.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein:

FIG. 4 shows a second operating mode of an intake and exhaust device according to an exemplary embodiment of the present invention;

Figure 1:
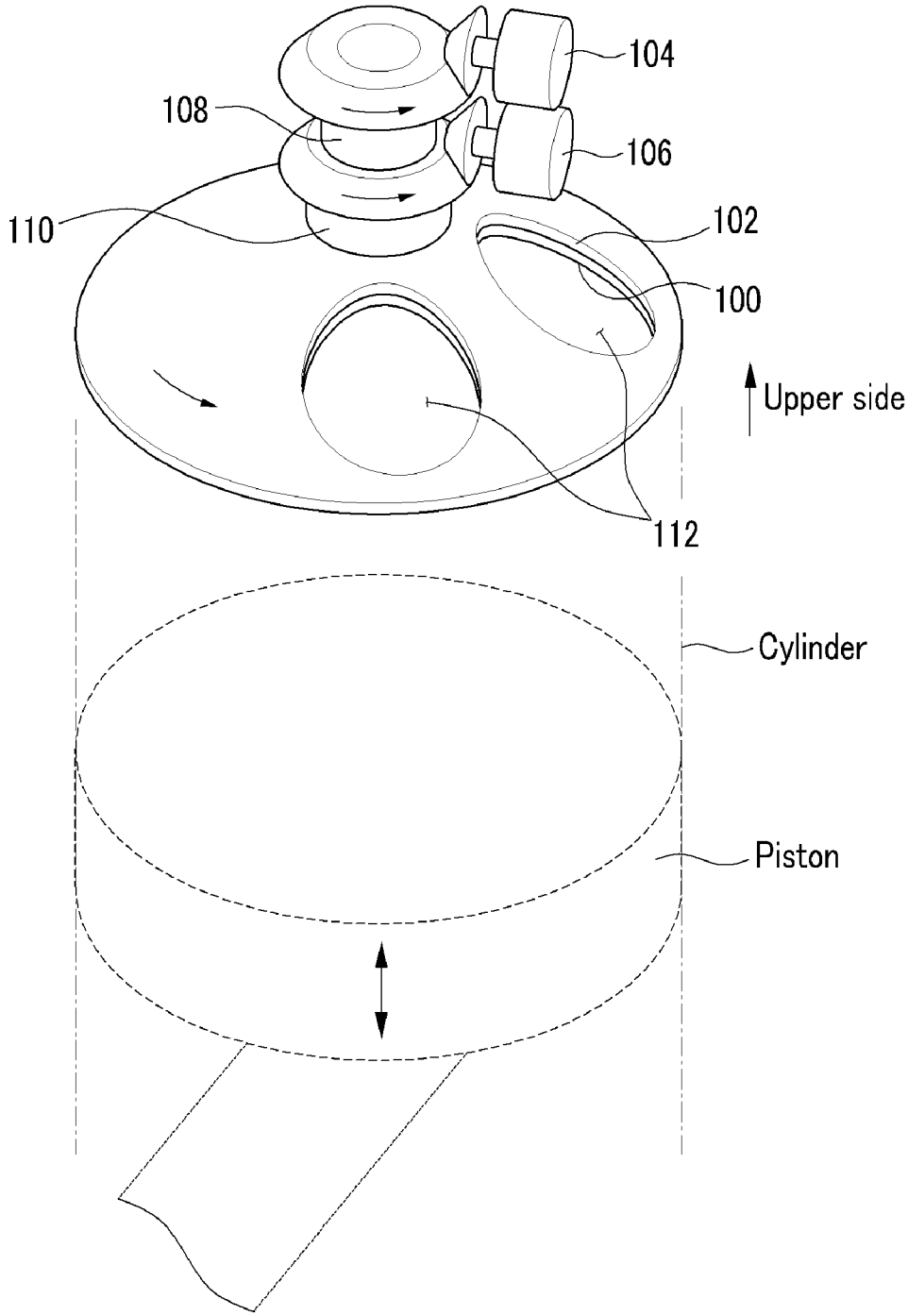
FIG. 1 shows a perspective view of an intake and exhaust device equipped with a first valve disk and a second valve disk according to an exemplary embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DESCRIPTION OF REFERENCE NUMERALS INDICATING PRIMARY ELEMENTS IN THE DRAWINGS

| | |
|---|---|
| 100: first valve disk | 102: second valve disk |
| 104: first drive motor | 106: second drive motor |
| 108: first driving pipe | 110: second driving pipe |
| 112: hole | 112a: first hole |
| 112b: second hole | 200: cylinder |
| 202: upper side | 204: intake port |
| 206: exhaust port | 500: ball |
| 502: spring | 504: groove |
| 600: crankshaft | 602, 802: first control disk |
| 604, 804: second control disk | 606, 806: third control disk |
| 608, 808: first electric terminal | 610, 810: second electric terminal |
| 612, 812: third electric terminal | 902: first cylinder |

-continued

| | |
|---|---|
| 904: second cylinder | 906: third cylinder |
| 908: fourth cylinder | |

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The present invention will be described more fully hereinafter with reference to the accompanying drawings, in which exemplary embodiments of the invention are shown.

The drawings and description are to be regarded as illustrative in nature and not restrictive. Like reference numerals designate like elements throughout the specification.

Figure 2:
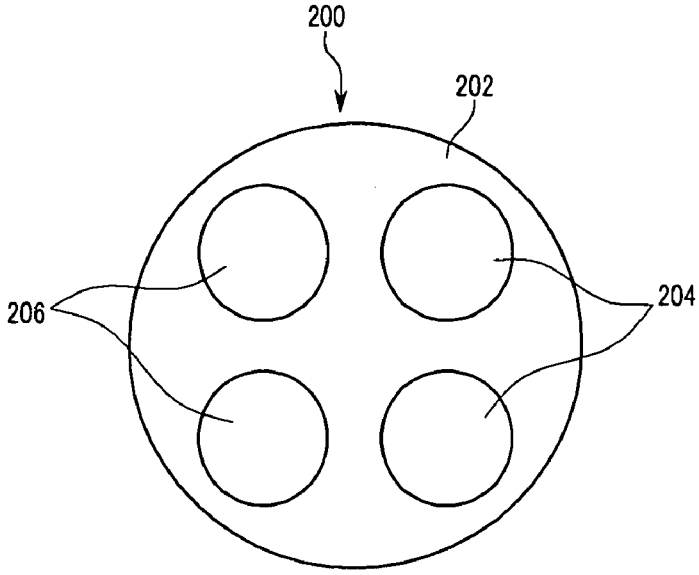
FIG. 2 shows a top plan view of a cylinder head in which an exhaust port and an intake port are formed according to an exemplary embodiment of the present invention.

FIG. 1 shows a perspective view of an intake and exhaust device equipped with a first valve disk and a second valve disk according to an exemplary embodiment of the present invention, and FIG. 2 shows a top plan view of a cylinder in which an exhaust port and an intake port are formed according to an exemplary embodiment of the present invention.

An intake and exhaust device according to the exemplary embodiment of the present invention includes a first valve disk 100, a second valve disk 102, a first driving pipe 108, a second driving pipe 110, a first drive motor 104, and a second drive motor 106.

As shown in FIG. 1, two holes 112 are formed in the first valve disk 100, and two holes 112 are formed in the second valve disk 102 corresponding to the holes 112 formed in the first valve disk 100.

The first valve disk 100 and the second valve disk 102 have a circular disk shape to cover an upper side of a cylinder. The diameter of the disks 100 and 102 is equal to or larger than a diameter of the cylinder bore.

As shown in FIG. 2, two intake ports 204 and two exhaust ports 206 are respectively formed in an upper side 202 of a cylinder 200.

Referring to FIG. 1 and FIG. 2, each hole 112 formed in the first valve disk 100 and the second valve disk 102 is formed corresponding to a shape of the intake port 204 or the exhaust port 206. The diameter of the holes 112 formed in the disks 100 and 102 is equal to or larger than an interior diameter of the intake port 204 or the exhaust port 206 in the exemplary embodiment of the present invention.

As shown in FIG. 1 and FIG. 2, the first valve disk 100 is overlapped on the second valve disk 102, and the exhaust port 206 and the intake port 204 of the cylinder 200 are opened or closed according to a rotation position thereof.

The first driving pipe 108 is connected to a center portion of the first valve disk 100, and the second driving pipe 110 is connected to the second valve disk 102. The first driving pipe 108 is slidingly inserted into the second driving pipe 110. An ignition device is inserted through the first driving pipe 108.

The first driving pipe 108 is connected to the first drive motor 104 through a gear (not shown), and the second driving pipe 110 is connected to the second drive motor 106 through a gear (not shown). The first valve disk 100 rotates by the first drive motor 104, and the second valve disk 102 rotates by the second drive motor 106.

Figure 3:
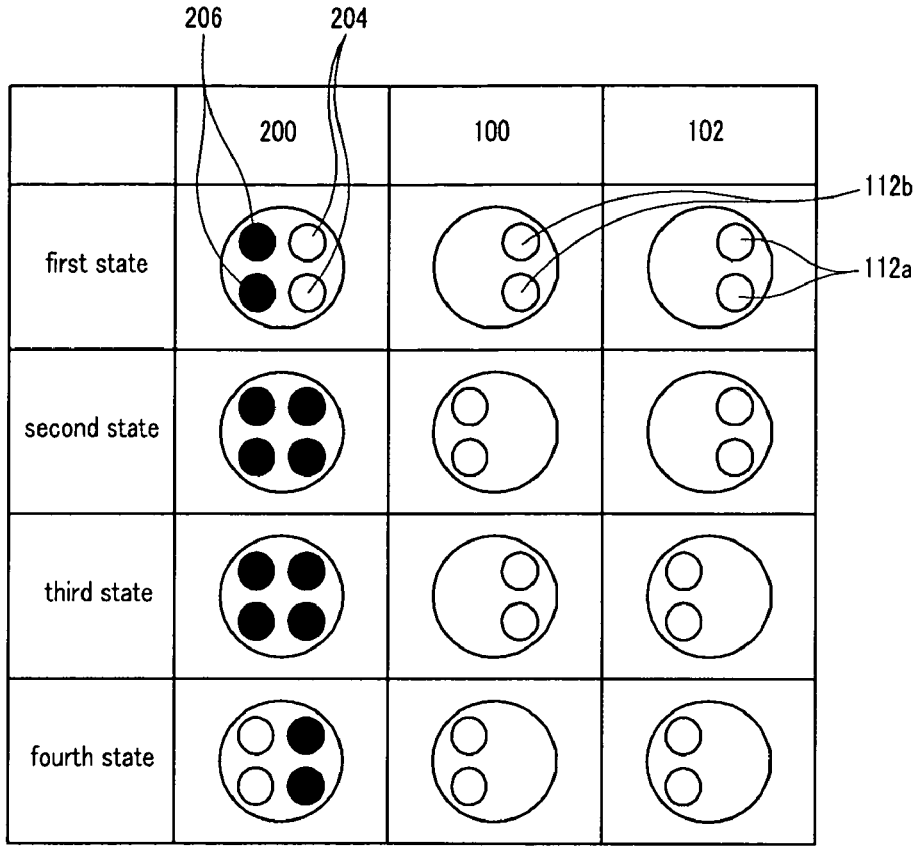
FIG. 3 shows a first operating mode of an intake and exhaust device according to an exemplary embodiment of the present invention.

FIG. 3 shows a first operating mode of an intake and exhaust device according to an exemplary embodiment of the present invention.

An opened state and a closed state of the intake ports 204 and exhaust ports 206 are shown according to a rotation position of the first valve disk 100 and the second valve disk 102.

The four ports are formed in each cylinder 200, and the two at the right are the intake ports 204 and the two at the left are the exhaust ports 206 in FIG. 3. Also, first holes 112a corresponding to the intake ports or the exhaust ports are formed in the first valve disk 100, and second holes 112b are formed in the second valve disk 102.

The intake ports 204 are opened and the exhaust ports 206 are closed in a first state according to a rotation position of the first valve disk 100 and the second valve disk 102, the intake ports 204 and the exhaust ports 206 are closed in a second state and a third state, and the intake port 204 is closed and the exhaust port 206 is opened in a fourth state.

FIG. 4 shows a second operating mode of an intake and exhaust device according to an exemplary embodiment of the present invention.

FIG. 4 shows a rotation position of the first valve disk 100 and the second valve disk 102 in a cylinder of an engine according to a first top dead center, an intake stroke, a first bottom dead center, a compression stroke, a second top dead center, an explosion stroke, a second bottom dead center, and an exhaust stroke.

Referring to FIG. 3 and FIG. 4, the first valve disk 100 and the second valve disk 102 rotate 90° clockwise when progressing from the first top dead center to the intake stroke. Accordingly, the intake ports 204 are opened completely and the exhaust ports 206 are closed completely. The first valve disk 100 rotates 90° and the second valve disk 102 does not rotate when progressing from the intake stroke to the first bottom dead center.

Also, the first valve disk 100 rotates 90° and the second valve disk 102 does not rotate when progressing from the first bottom dead center to the compression stroke. Accordingly, the intake ports 204 and the exhaust ports 206 are closed completely. The first valve disk 100 and the second valve disk 102 respectively rotate 90° when progressing from the compression stroke to the second top dead center. Then, the first valve disk 100 and the second valve disk 102 rotate 90° when progressing from the second top dead center to the explosion stroke. Accordingly, the intake ports 204 and exhaust ports 206 are closed completely.

As stated above, the exhaust ports 206 are opened in the exhaust stroke. The control portion for controlling a rotation of the first valve disk 100 and the second valve disk 102 will now be explained referring to FIG. 6A and FIG. 6B in the exemplary embodiment of the present invention, and with reference to FIG. 5.

Figure 5:
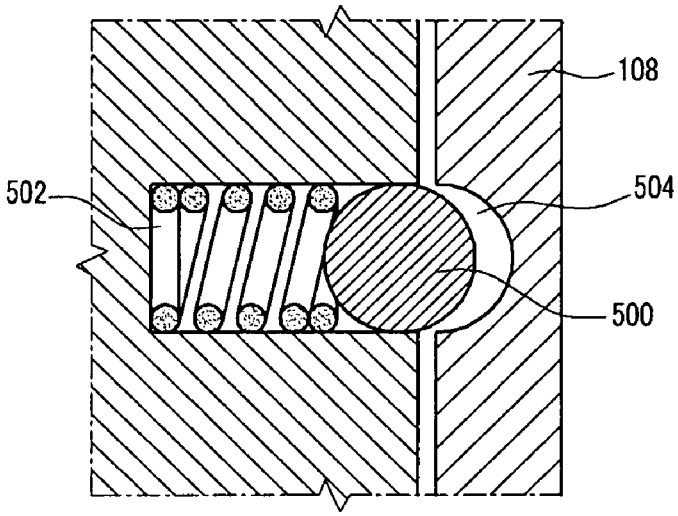
FIG. 5 shows a partial cross-sectional view of an intake and exhaust device according to an exemplary embodiment of the present invention.

FIG. 5 is showing a partial cross-sectional view of an intake and exhaust device according to an exemplary embodiment of the present invention.

As shown, a groove 504 is formed in the first driving pipe 108, and a ball 500 is elastically supported to an inside of the groove 504 by a spring 502. Accordingly, the rotation position of the first driving pipe 108 is established.

Figure 6A:
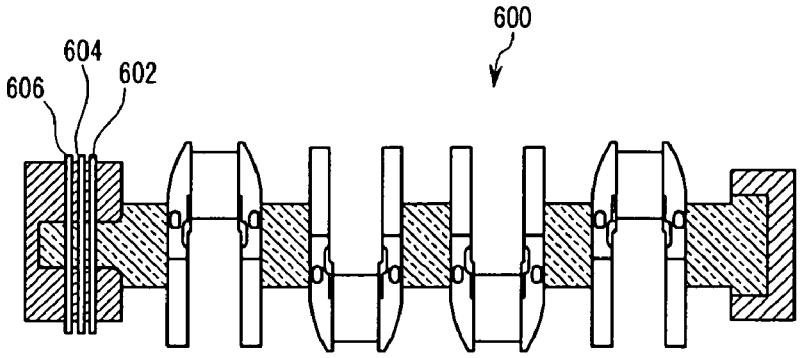
FIG. 6A shows a side view of an intake and exhaust device according to an exemplary embodiment of the present invention.

FIG. 6A shows a side view of an intake and exhaust device according to an exemplary embodiment of the present invention.

As shown, a first control disk 602, a second control disk 604, and a third control disk 606 are formed in one end portion of a crankshaft 600. The disks 602, 604, and 606 are stacked with each other. Particularly, the first control disk 602 and the third control disk 606 do not rotate, and only the second control disk 604 rotates together with the crankshaft 600 in the exemplary embodiment of the present invention.

Figure 6B:
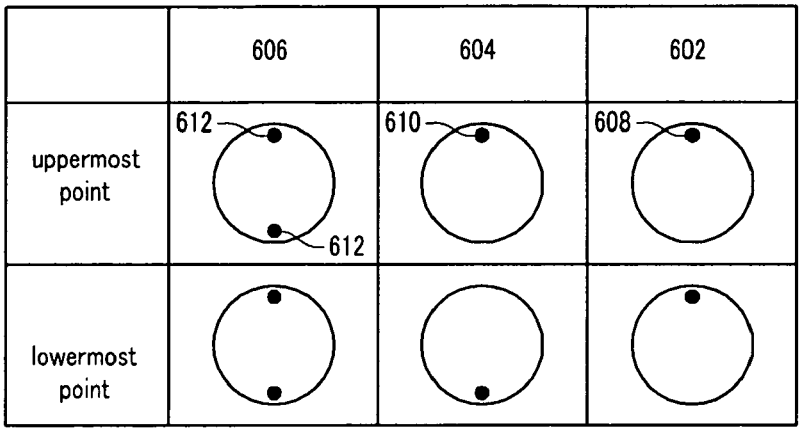
FIG. 6B shows a first exploded side view of a control portion of an intake and exhaust device according to an exemplary embodiment of the present invention.

FIG. 6B shows a first exploded side view of a control portion of an intake and exhaust device according to an exemplary embodiment of the present invention.

As shown, a first electric terminal 608 is formed at an edge of the first control disk 602 (upper portion of FIG. 6B), and a second electric terminal 610 is formed at an edge of the second control disk 604.

As described above, the first control disk 602 does not rotate, so the first electric terminal 608 is fixed. Further, the first electric terminal 608 and the second electric terminal 610 are connected or disconnected according to a rotation position of the second electric terminal 610 formed in the second control disk 604.

Two third electric terminals 612 are formed at opposite side edges of the third control disk 606. And as described above, the third control disk 612 does not rotate, so the third electric terminals 612 are fixed. Also, the third electric terminals 612 are connected or disconnected to/from the second electric terminal 610 according to a rotation position of the second electric terminal 610.

FIG. 6B shows positions of the electric terminals 608, 610, and 612 at top dead center and bottom dead center of a piston.

The first electric terminal 608 and the second electric terminal 610 contact each other and the second electric terminal 610 and the third electric terminal 612 contact each other at top dead center. Also, the second electric terminal 610 and the third electric terminal 612 contact each other at bottom dead center.

The first valve disk 100 and the second valve disk 102 rotate together according to contact states of the terminals at top dead center, and only the first valve disk 100 rotates at bottom dead center.

A contacting state can be measured by detecting an electrical current when an electrical current flows through the electric terminals 608, 610, and 612 formed in the control disks 602, 604, and 606 and they are in electrical contact in the exemplary embodiment of the present invention.

For example, a regular current is applied through the second electric terminal 610 of the second control disk 604, and a contacting state can be measured by detecting a current applied to the second electric terminal through the first electric terminal 608 when the second electric terminal 610 and the first electric terminal 608 contact.

Figure 7:
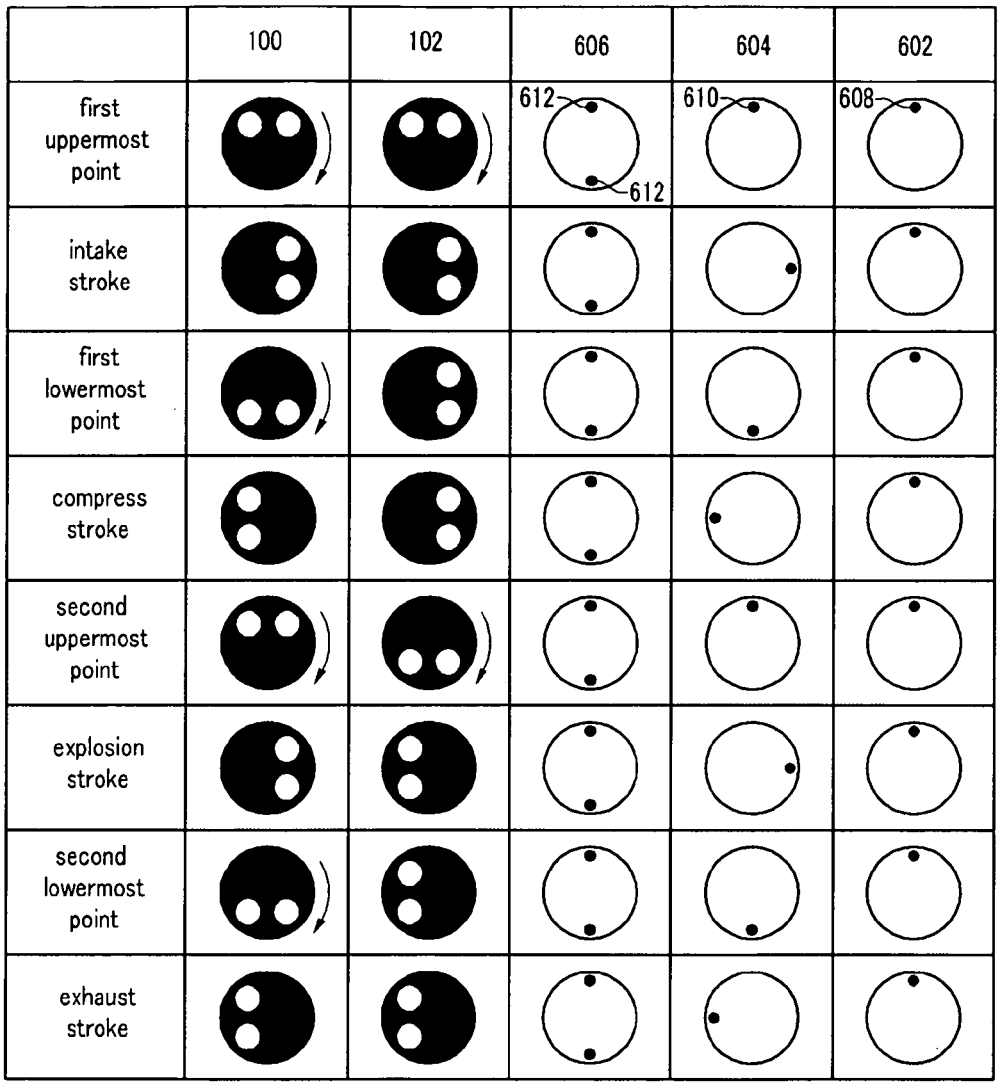
FIG. 7 shows a third operating mode of an intake and exhaust device according to an exemplary embodiment of the present invention.

FIG. 7 shows a third operating mode of an intake and exhaust device according to an exemplary embodiment of the present invention.

FIG. 7 shows a state of the intake and exhaust device of one cylinder equipped in an engine. Also, FIG. 7 shows states of the first valve disk 100, the second valve disk 102, the first control disk 602, the second control disk 604, and the third control disk 606 at top dead center, at an intake stroke, at bottom dead center, at a compression stroke, at top dead center, at an explosion stroke, at bottom dead center, and at an exhaust stroke.

The first electric terminal 608 of the first control disk 602 contacts the second electric terminal 610 of the second control disk 604 and the second electric terminal 610 contacts the third electric terminal 612 of the third control disk 606 at the first top dead center. Accordingly, the first valve disk 100 and the second valve disk 102 rotate 90° clockwise. Therefore, the intake ports 204 are opened in the intake stroke.

The second electric terminal 610 of the second control disk 604 contacts the third electric terminal 612 of the third control disk 606 at the first bottom dead center. Accordingly, the first valve disk 100 rotates 90°

Therefore, the intake port 204 and the exhaust port 206 are closed in the compression stroke.

The first valve disk 100 and the second valve disk 102 rotate 90° at the second top dead center like at the first top dead center. Therefore, the intake port 204 and the exhaust port 206 sustain their closed state in the explosion stroke.

The first valve disk 100 rotates 90° at the second bottom dead center like at the first bottom dead center. Therefore, the exhaust port 206 is opened in the exhaust stroke.

Figure 8:
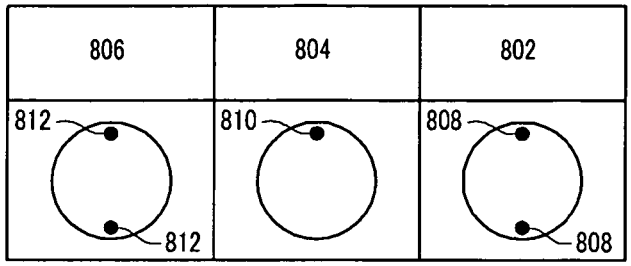
FIG. 8 shows a second exploded side view of a control portion of an intake and exhaust device according to an exemplary embodiment of the present invention.

FIG. 8 shows a second exploded side view of a control portion of an intake and exhaust device according to an exemplary embodiment of the present invention.

The control portion includes a first control disk 802, a second control disk 804, and a third control disk 806 in FIG. 8. Two first electric terminals 808 are formed at opposite side edges of the first control disk 802, and the second electric terminal 810 is formed at one side edge of the second control disk 804. Also, two third electric terminals 812 are formed at opposite side edges of the third control disk 806.

As described above, the first control disk 802 and the third control disk 806 do not rotate, and the second control disk 804 rotates with the crankshaft 600. The first electric terminal 808 and the second electric terminal 810 contact according to a rotation position of the second control disk 804, and the second electric terminal 810 and the third electric terminal 812 contact each other.

Figure 9A:
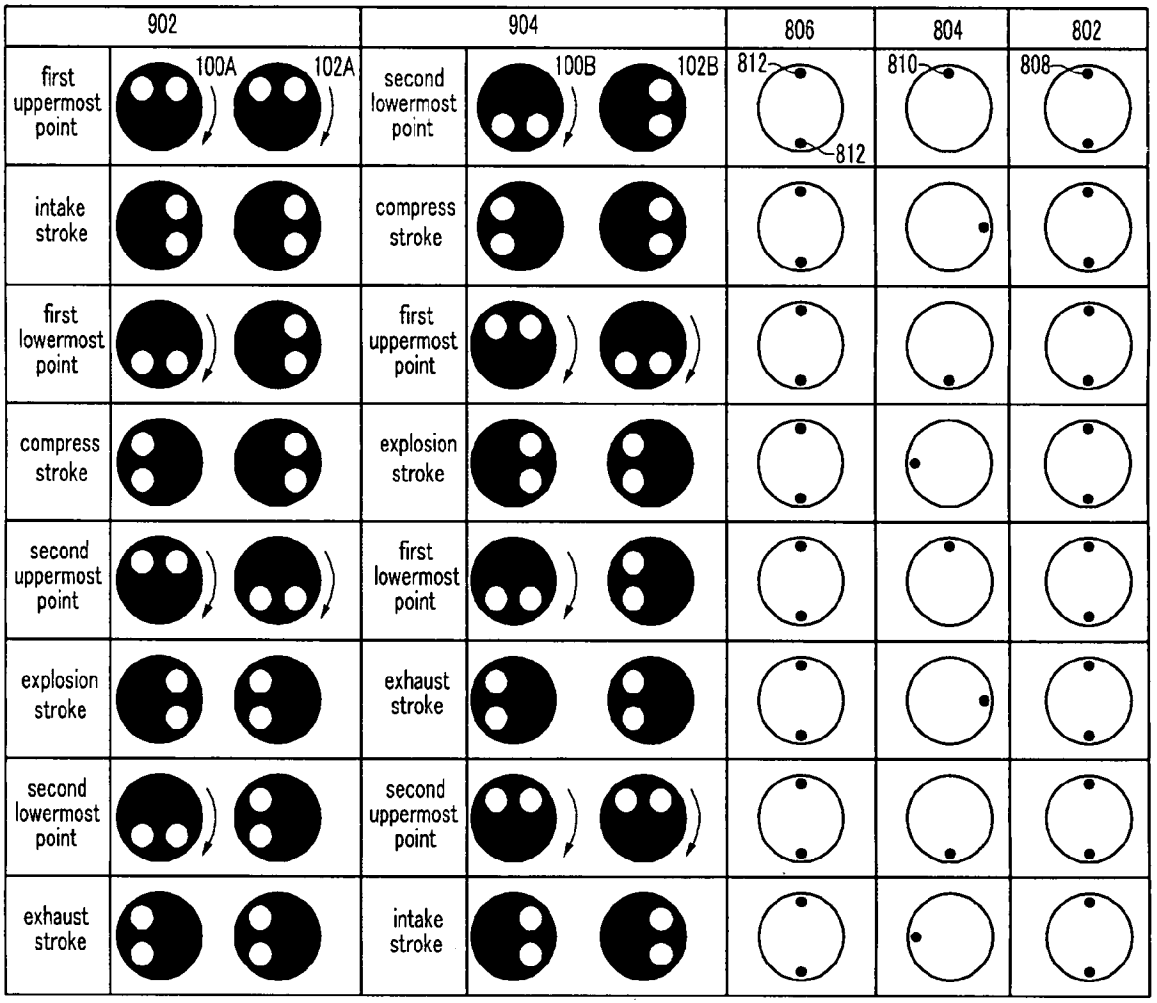
FIG. 9*a* shows a fourth operating mode of an intake and exhaust device according to an exemplary embodiment of the present invention.
Figure 9B:
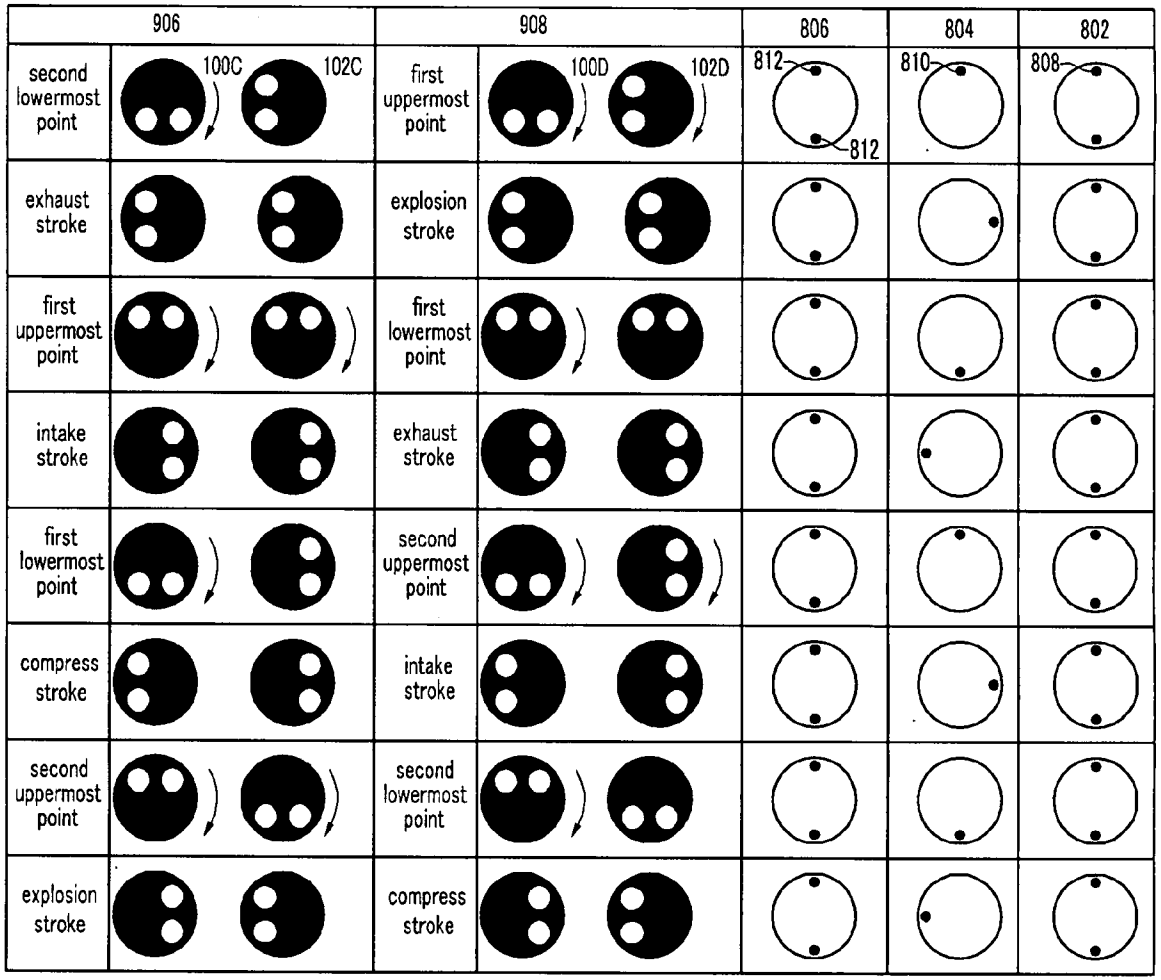
FIG. 9*b* shows a fourth operating mode of an intake and exhaust device according to an exemplary embodiment of the present invention.

FIG. 9A shows a fourth operating mode of an intake and exhaust device according to an exemplary embodiment of the present invention. FIG. 9B shows a fourth operating mode of an intake and exhaust device according to an exemplary embodiment of the present invention. FIGS. 9A and 9B are showing one engine having four cylinders.

The first valve disk (100A, 100B, 100C, 100D) and the second valve disk (102A, 102B, 102C, 102D) respectively open or close the intake ports 204 and the exhaust ports 206 in the first cylinder 902, the second cylinder 904, the third cylinder 906, and the fourth cylinder 908, so the intake ports 204 are opened in the intake stroke and the exhaust ports 206 are opened in the exhaust stroke.

Basically, an engine of FIG. 9 is operated by the control portion of FIG. 8.

Referring to FIG. 8, FIG. 9A and 9B, more particularly, one of the two first electric terminals 808 in the first control disk 802 controls the second valve disks 102A and 102D provided in the first cylinder 902 and the fourth cylinder 908, and the other controls the second valve disks 102B and 102C provided in the second cylinder 904 and the third cylinder 906. Also, the two third electric terminals 812 in the third control disk 806 control the first valve disk (100A, 100B, 100C, 100D) in all cylinders.

The second cylinder 904 and the third cylinder 906 are at bottom dead center when the first cylinder 902 and the fourth cylinder 908 are at top dead center. The first electric terminal 808 of the first control disk 802 and the second electric terminal 810 of the second control disk 804 are electrically connected when the first cylinder 902 is at top dead center. Accordingly, the second valve disks 102A and 102D of the first cylinder 902 and the fourth cylinder 908 rotate 90°. Further, the second electric terminal 810 of the second control disk 804 and the third electric terminal 812 of the third control disk 806 contact each other. Accordingly, the first valve disks (100A, 100B, 100C, 100D) rotate 90° for all of the cylinders (902, 904, 906, 908).

The control portion (not shown) analyzes an electrical signal outputted from the electric terminal of the control disks, and based on the analyzed data the control portion supplies a driving voltage to the first drive motor 104 and the second drive motor 106 provided in the intake and exhaust in the exemplary embodiment of the present invention. Accordingly, the first valve disk 100 and the second valve disk 102 rotate. The control portion can be included in an ECU of a vehicle. In addition, a step motor is applied in the first drive motor 104 and the second drive motor 106 in the exemplary embodiment of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An intake and exhaust device equipped with a first valve disk and a second valve disk, comprising:

a cylinder in which an intake port and an exhaust port are formed;

a circular first valve disk in which a first hole corresponding to one of the intake port and the exhaust port is formed, and that covers an upper side of the cylinder including the intake port and the exhaust port;

a circular second valve disk that is slidingly overlapped on the first valve disk and in which a second hole corresponding to the first hole is formed;

a first driving portion for rotating a first driving pipe that is fixed to a center of the first valve disk;

a second driving portion for rotating a second driving pipe that surrounds the first driving pipe and is fixed to the second valve disk; and a control portion for controlling the first driving portion and the second driving portion, wherein the intake port or the exhaust port opens or closes when the first valve disk or the second valve disk rotate.

2. The intake and exhaust device equipped with the first valve disk and the second valve disk of claim 1, wherein the control portion comprises:

a first control disk in which a first electric terminal is formed adjacent to an edge thereof;

a second control disk that is overlapped on a side of the first control disk and that has a second electric terminal configured to correspond to the first electric terminal, and of which a center portion is connected to a crankshaft to rotate; and a third control disk that is overlapped on other side of the second control disk and that has two third electric terminals configured to alternatively correspond to the second electric terminal and that are symmetrically formed at 180 degrees from each other.

3. The intake and exhaust device equipped with the first valve disk and the second valve disk of claim 1, wherein the control portion comprises:

a first control disk in which two first electric terminals are symmetrically formed at 180 degrees to each other on an edge thereof;

a second control disk that is overlapped on a side of the first control disk and a second electric terminal is configured to alternatively correspond to one of the first electric terminals, and of which a center portion thereof is connected to a crankshaft to rotate; and a third control disk that is overlapped on other side of the second control disk, and two third electric terminals are formed symmetrically at 180 degrees from each other on an edge thereof to alternatively correspond to the second electric terminal.

4. The intake and exhaust device equipped with the first valve disk and the second valve disk of claim 1, wherein the driving portion is operated by an electric motor.

5. The intake and exhaust device equipped with the first valve disk and the second valve disk of claim 1, wherein the first driving portion is engaged with the first driving pipe by a spiral bevel gear.

6. The intake and exhaust device equipped with the first valve disk and the second valve disk of claim 1, wherein the second driving portion is engaged with the second driving pipe by a spiral bevel gear.

7. The intake and exhaust device equipped with the first valve disk and the second valve disk of claim 1, wherein there are two intake ports and two exhaust ports in a cylinder.

8. The intake and exhaust device equipped with the first valve disk and the second valve disk of claim 7, wherein there are two first holes and two second holes corresponding to the intake ports or the exhaust ports.

9. The intake and exhaust device equipped with the first valve disk and the second valve disk of claim 1, wherein the number of cylinders is four.

10. The intake and exhaust device equipped with the first valve disk and the second valve disk of claim 1, wherein the first driving pipe has a pipe shape and an ignition device is inserted into the cylinder through the first driving pipe.

11. The intake and exhaust device equipped with the first valve disk and the second valve disk of claim 10, wherein the ignition device is a spark plug.

12. The intake and exhaust device equipped with the first valve disk and the second valve disk of claim 1, wherein a diameter of the first hole and the second hole is equal to or larger than a diameter of the intake port or the exhaust port.

* * * * *